US006275041B1

(12) United States Patent
Okamura et al.

(10) Patent No.: US 6,275,041 B1
(45) Date of Patent: Aug. 14, 2001

(54) COMBUSTION STATE DETECTING APPARATUS FOR INTERNAL COMBUSTION ENGINE

(75) Inventors: Koichi Okamura; Yasuyoshi Hatazawa; Shu Sasaki; Mitsuru Koiwa; Yutaka Ohashi; Hisanori Nobe, all of Tokyo (JP)

(73) Assignee: Mitsubishi Denki Kabushiki Kiasha, Tokyo (JP)

( * ) Notice: Subject to any disclaimer, the term of this patent is extended or adjusted under 35 U.S.C. 154(b) by 0 days.

(21) Appl. No.: 09/500,477

(22) Filed: Feb. 9, 2000

(30) Foreign Application Priority Data

Oct. 7, 1999 (JP) ..... 11-286899

(51) Int. Cl.[7] ..... F02B 17/00
(52) U.S. Cl. ..... 324/380; 324/388; 73/35.08
(58) Field of Search ..... 73/35.08; 324/380, 324/388, 399, 464

(56) References Cited

U.S. PATENT DOCUMENTS 5,548,220 * 8/1996 Kawamoto et al. ..... 324/399
5,781,012 * 6/1998 Yasuda ..... 324/399
6,011,397 * 1/2000 Yasuda ..... 324/388
6,196,054 * 3/2001 Okamura et al. ..... 73/35.08

FOREIGN PATENT DOCUMENTS 5-231293 9/1993 (JP) ..... F02P/17/00

* cited by examiner

*Primary Examiner*—Safet Metjahic
*Assistant Examiner*—Vincent Q. Nguyen
(74) *Attorney, Agent, or Firm*—Sughrue, Mion, Zinn, Macpeak & Seas, PLLC

(57) ABSTRACT

A combustion state detecting apparatus for an internal combustion engine is imparted with facility for determining discriminatively the causes for non-occurrence of combustion. The apparatus includes a spark plug (4) for generating a spark discharge upon application of a high voltage generated by an ignition coil (1) in response to an ignition signal (X1) to thereby fire an air-fuel mixture within a cylinder of the internal combustion engine, an ion current detecting means (6A) for detecting as ion current detection signals (X2*a*; X2) an ion current corresponding to an amount of ions produced within the cylinder immediately after combustion of the air-fuel mixture, a signal detecting means (7A; 7B; 9) for comparing the ion current detection signal (X2*a*) outputted from the ion current detecting means (6A) with a first reference voltage (Vth1) to thereby output a first decision signal (X3) while comparing the ion current detection signal (X2) with a second reference voltage (Vth2) to thereby output a second decision signal (X4) while invalidating output of the second decision signal (X4) during a predetermine time period from a time point at which the comparison of the ion current detection signal (X2) with the second reference voltage (Vth2) is started, and an estimating logic unit (9, 10; 112) for estimating a cause for nongeneration of a combustion signal on the basis of output statuses of the first decision signal (X3) and the second decision signal (X4).

7 Claims, 5 Drawing Sheets

FIG. 3

| CORRELATIONS BETWEEN TYPES OF FAULTS AND FIRST / SECOND DECISION SIGNALS | | | | |
|---|---|---|---|---|
| NAMES OF COMPONENTS | | TYPES OF FAULTS | FIRST DECISION SIGNAL X3, X3A | SECOND DECISION SIGNAL X4 |
| ECU | | NO GENERATION OF IGNITION SIGNAL | ABSENCE OF OUTPUT | ABSENCE OF OUTPUT |
| IGNITION SIGNAL CONDUCTOR | | BREAKAGE | ABSENCE OF OUTPUT | ABSENCE OF OUTPUT |
| IGNITION COIL | POWER TRANSISTOR | CONDUCTING, NOT TURNED OFF | ABSENCE OF OUTPUT | ABSENCE OF OUTPUT |
| | PRIMARY WINDING | BREAKAGE | ABSENCE OF OUTPUT | ABSENCE OF OUTPUT |
| | SECONDARY WINGING | BREAKAGE (SHORT-CIRCUIT) | PRESENCE OF OUTPUT | ABSENCE OF OUTPUT |
| ION CURRENT CONDUCTOR | | BREAKAGE | ABSENCE OF OUTPUT | ABSENCE OF OUTPUT |
| COMBUSTION STATE DETECTOR | | NONGENERATION OF OUTPUT SIGNAL | ABSENCE OF OUTPUT | ABSENCE OF OUTPUT |
| HIGH-VOLTAGE CORD | | BREAKAGE | PRESENCE OF OUTPUT | ABSENCE OF OUTPUT |
| SPARK PLUG | | SMOLDERING | PRESENCE OF OUTPUT | ABSENCE OF OUTPUT |
| PARTS OF FUEL SUPPLY SYSTEM | | NO FUEL SUPPLY | PRESENCE OF OUTPUT | ABSENCE OF OUTPUT |

FIG. 4

| CORRELATIONS BETWEEN TYPES OF FAULTS AND FIRST / SECOND DECISION SIGNALS (COMBUSTION STATE DETECTOR IS INCORPORATED IN IGNITION COIL) | | | | |
|---|---|---|---|---|
| NAMES OF COMPONENTS | | TYPES OF FAULTS | FIRST DECISION SIGNAL X3, X3A | SECOND DECISION SIGNAL X4 |
| ECU | | NO GENERATION OF IGNITION SIGNAL | ABSENCE OF OUTPUT | ABSENCE OF OUTPUT |
| IGNITION SIGNAL CONDUCTOR | | BREAKAGE | ABSENCE OF OUTPUT | ABSENCE OF OUTPUT |
| IGNITION COIL | POWER TRANSISTOR | CONDUCTING, NOT TURNED OFF | ABSENCE OF OUTPUT | ABSENCE OF OUTPUT |
| | PRIMARY WINDING | BREAKAGE | ABSENCE OF OUTPUT | ABSENCE OF OUTPUT |
| | SECONDARY WINGING | BREAKAGE | PRESENCE OF OUTPUT | ABSENCE OF OUTPUT |
| | COMBUSTION STATE DETECTOR | NONGENERATION OF OUTPUT SIGNAL | ABSENCE OF OUTPUT | ABSENCE OF OUTPUT |
| HIGH-VOLTAGE CORD | | BREAKAGE | PRESENCE OF OUTPUT | ABSENCE OF OUTPUT |
| SPARK PLUG | | SMOLDERING | PRESENCE OF OUTPUT | ABSENCE OF OUTPUT |
| PARTS OF FUEL SUPPLY SYSTEM | | NO FUEL SUPPLY | PRESENCE OF OUTPUT | ABSENCE OF OUTPUT |

COMBUSTION STATE DETECTING APPARATUS FOR INTERNAL COMBUSTION ENGINE

BACKGROUND OF THE INVENTION

1. Field of the Invention

The present invention relates to a combustion state detecting apparatus for an internal combustion engine, which apparatus is designed for detecting the combustion state of an air-fuel mixture within a cylinder or cylinders of the engine by detecting an ion current making appearance upon combustion of the air-fuel mixture. More particularly, the invention is concerned with a combustion state detecting apparatus for the internal combustion engine, which apparatus is imparted with a function or facility for estimating the causes for non-generation or disappearance of a combustion signal based on the ion current.

2. Description of Related Art

For having better understanding of the concept underlying the present invention, background techniques thereof will first be reviewed in some detail.

FIG. 5A is a circuit diagram showing schematically an arrangement of a hitherto known or conventional combustion state detecting apparatus for an internal combustion engine (hereinafter also referred to simply as the engine), which apparatus is designed for detecting the combustion state within an engine cylinder or cylinders on the basis of an ion current produced upon combustion of air-fuel mixture. Referring to the figure, reference numeral 1 denotes an ignition coil which includes a primary winding 11 having a high-voltage end connected to a positive electrode of a power supply source 3 such as an onboard battery, while the low-voltage end of the primary winding 11 is connected to a collector electrode of a power transistor 2 which serves as a switching element for turning on/off a primary current flowing through the primary winding 11. The power transistor has an emitter electrode connected to the ground potential. On the other hand, a secondary winding 12 of the ignition coil 1 has a high-voltage end connected to an electrode of a spark plug 4 disposed within a cylinder of the engine while a low-voltage end of the secondary winding 12 is connected to a bias circuit 5 which is designed to apply a bias voltage of positive polarity to the spark plug 4 through a wiring conductor.

Further, referring to FIG. 5A, reference numeral 6 denotes an ion current detecting circuit which is designed for detecting by way of the bias circuit 5 an ion current making appearance upon combustion of the air-fuel mixture and flowing through an inter-electrode gap of the spark plug 4 to thereby convert the ion current into a voltage signal. More specifically, the ion current detecting circuit 6 is implemented in the form of a conventional current mirror circuit constituted by a series connection of transistors Q1*a* and Q1*b* and a transistor Q2 which are connected in parallel between a positive voltage source (i.e., voltage source of plus or positive polarity) +V and the ground potential. A resistor R1 is inserted between the ground potential and the collector of the transistor Q2. A current analogous to the ion current flows through the resistor R1 to undergo a voltage conversion, whereby an ion current detection voltage signal (hereinafter referred to as the ion current detection signal) X2 is produced.

The ion current detection signal X2 is supplied to a decision circuit 7 which is designed for shaping the ion current detection signal X2 detected by the ion current detecting circuit 6 into a pulse signal, which then undergoes a processing for deciding occurrence of combustion of the air-fuel mixture, as a result of which a pulse-like decision signal X3 is outputted from the decision circuit 7 to be supplied to an ECU (Electronic Control Unit) 10.

More specifically, for shaping the ion current detection signal X2 resulting from the voltage conversion mentioned above into a pulse signal, the decision circuit 7 includes a comparator circuit composed of a comparator CP1 for comparing the level of the ion current detection signal X2 with a reference voltage Vth4, an integrating circuit composed of a resistor R2 and a capacitor C2 for eliminating noise components N1 and N2 superposed on the pulse-like ion current outputted from the comparator CP1, and a delay circuit composed of a comparator CP2. Parenthetically, it should be mentioned that a pull-up resistor R3 connected to the output terminal of the comparator CP2 serves for pulling up the output voltage level thereof.

Next, referring to a signal waveform diagram shown in FIG. 5B, description will be made of operations of the conventional combustion state detecting apparatus in conjunction with normal combustion, a first type of non-combustion event (e.g. due to absence of fuel supply) and a second type of non-combustion event (e.g. due to failure of generation of high voltage for firing).

1. Normal combustion

Upon rising of the ignition signal X1 applied to the base of the power transistor 2 under the control of the ECU 10, the current flowing through the primary winding 11 of the ignition coil 1 is interrupted, as a result of which a high voltage E is induced in the secondary winding 12 of the ignition coil 1, whereby a spark discharge is caused to take place within the inter-electrode gap of the spark plug 4.

The ion current generated due to the combustion of the air-fuel mixture within the engine cylinder in which the spark discharge has taken place is inputted to the ion current detecting circuit 6 by way of the bias circuit 5 to undergo the current-to-voltage conversion in the current mirror circuit, whereby the ion current detection signal X2 is outputted from the ion current detecting circuit 6.

At this juncture, it should be mentioned that the ion current detection signal X2 outputted from the circuit 6 contains in addition to the intrinsic ion current component due to the combustion of the air-fuel mixture a noise component N1 produced upon rising of the ignition signal and the noise component N2 making appearance upon termination or extinction of the spark discharge. Accordingly, these noise components N1 and N2 have to be eliminated before outputting the decision signal X3 for deciding the combustion event on the basis of the ion current.

Thus, before eliminating the noise components N1 and N2 through the medium of the delay circuit, the ion current detection signal X2 is inputted to the comparator CP1 constituting the comparator circuit for comparing the levels of the signal components of the ion current detection signal X2 with the reference voltage Vth4. Since each of the noise components N1 and N2 is intrinsically in the form of a spike-like signal, these components are shaped into pulses each having an extremely short time duration.

Thus, even when the pulse-like noise components N1 and N2 are inputted to the CR integrating circuit constituting a part of the delay circuit to thereby raise the charge voltage of the capacitor C2 up to or beyond the reference voltage Vth5 preset at the comparator CP2, the pulse-like noise components Ni and N2 will assume low level before the charge voltage of the capacitor C2 reaches the reference voltage Vth5 because the time duration of the noise components is short of the CR time constant. Consequently, no decision signal will be outputted from the comparator CP2 in response to the noise components N1 and N2.

On the other hand, when the ion current component undergone the pulse-shaping operation is inputted to the integrating circuit, the capacitor C2 is charged to a level equal to or exceeding the reference voltage Vth5 after lapse of a predetermined time, because the time duration of the pulse-like ion current component is greater than the CR time constant, as a result of which the output of the comparator CP2 becomes high, whereby the decision signal X3 indicating that the combustion has taken place normally, i.e., normal combustion, is outputted.

At this juncture, the time taken for the charge voltage of the capacitor C2 to exceed the reference voltage Vth5 will be defined as the mask period only for convenience of description. Then, the noise components making appearance upon rising of the ion current and termination or extinction of the spark discharge, respectively, can be eliminated during the mask period.

2. Non-combustion event due to absence of fuel supply

When the fuel supply is absent, i.e., unless the air-fuel mixture is normally charged into the engine cylinder, the ion current due to the combustion of the air-fuel mixture can not naturally flow. Of course, upon rising of the ignition signal X1 as well as upon extinction of the spark discharge occurring within the intra-electrode gap of the spark plug 4, the noise components N1 and N2 make appearance, which would be outputted as the ion current detection signal X2. However, because the noise components N1 and N2 are eliminated by the delay circuit described previously in conjunction with the normal combustion, the decision signal X3 attributable to these noise components can not be generated.

3. Non-combustion event due to failure of generation of secondary voltage by the ignition coil As can easily be appreciated from the foregoing description, unless the high-voltage is induced in the secondary winding of the ignition coil 1 due to e.g. breakage of the primary winding thereof, neither the noise component N1 due to application (rising) of the ignition signal X1 nor the noise component N2 upon extinction of the spark discharge can be produced. Consequently, the decision signal X3 is not outputted.

As will now be understood from the foregoing, with the conventional combustion state detecting apparatus of the structure described above, it is certainly possible to detect the combustion events, i.e., combustion and non-combustion of the air-fuel mixture within the cylinder(s) of the internal combustion engine. However, it is impossible to determine discriminatively or identify the cause for occurrence of the non-combustion event. In other words, additional detecting means or facilities have to be provided for specifying the cause for occurrence of the non-combustion event, which will however incur increase of manufacturing cost and overhead inclusive of processing time, giving rise to problems.

SUMMARY OF THE INVENTION

In the light of the state of the art described above, it is an object of the present invention to provide a combustion state detecting apparatus for an internal combustion engine, which apparatus is capable of estimating the causes for nongeneration of the combustion signal.

In view of the above and other objects which will become apparent as the description proceeds, there is provided according to a general aspect of the present invention a combustion state detecting apparatus for an internal combustion engine, which apparatus includes a spark plug for generating a spark discharge upon application of a high voltage generated by an ignition coil in response to an ignition signal to thereby fire an air-fuel mixture within a cylinder of the internal combustion engine, an ion current detecting means for detecting as ion current detection signals an ion current corresponding to an amount of ions produced within the cylinder immediately after combustion of the air-fuel mixture, a signal detecting means designed for comparing the ion current detection signal outputted from the ion current detecting means with a first reference voltage to thereby output a first decision signal while comparing the ion current detection signal with a second reference voltage to thereby output a second decision signal while invalidating output of the second decision signal during a predetermine time period from a time point at which the comparison of the ion current detection signal with the second reference voltage is started, and an estimating means for estimating a cause for nongeneration of a combustion signal on the basis of output statuses of the first decision signal and the second decision signal.

By virtue of the arrangement of the combustion state detecting apparatus for the engine described above, there can be obtained advantageous effect that the cause for the non-combustion event can be detected at an earlier time.

In a preferred mode for carrying out the invention, the signal detecting means may be comprised of a first detecting unit for detecting noise signal components on the basis of result of the comparison of the ion current detection signal with the first reference voltage, and a second detecting unit for detecting an ion current component due to the combustion of the air-fuel mixture on the basis of result of the comparison of the ion current detection signal with the second reference voltage set lower than the first reference voltage.

With the arrangement of the combustion state detecting apparatus described above, detection of occurrence and non-occurrence of combustion events can be realized with enhanced accuracy and reliability while avoiding adverse influence of external noises and the like.

In another preferred mode for carrying out the invention, the estimating means may be so designed as to set a predetermined time period extending from a time point at which output of the first decision signal is started after firing of the air-fuel mixture as a detection period for the first decision signal while setting a predetermined period extending from a time point at which the detection period for the first decision signal is terminated as a detection period for the second decision signal so that the first and second decision signals can be detected discriminatively from each other.

By detecting the first and second decision signals distinctively from each other, the signals for specifying the cause(s) for non-occurrence of the combustion event can be detected stably with high reliability, to another advantage.

In yet another preferred mode for carrying out the invention, the estimating means may be so designed as to set a signal detection quiescent period over a predetermined time period which succeeds immediately to interruption of the ignition signal.

Owing to the arrangement mentioned above, the signals for specifying the cause(s) for non-occurrence of the combustion event can be detected stably, to a further advantage.

In still another preferred mode for carrying out the invention, the estimating means may be so designed as to output noise component signals only during an output period of the ignition signal.

With the arrangement mentioned above, setting of the timing for outputting the noise component signals can be much facilitated, to yet another advantage.

In a further preferred mode for carrying out the invention, the estimating means may be so designed as to limit a detection period for the noise component signals to within the output period of the ignition signal.

With the above-mentioned arrangement, setting of the timing for detecting the noise component signals can equally be facilitated, to an advantage.

In a yet further preferred mode for carrying out the invention, the ion current detecting means and the signal detection means may be built in the ignition coil.

With the arrangement mentioned above, exchange or retrofit of relevant part(s) or device(s) for disposing of the non-combustion event (i.e., non-occurrence of the combustion event) can be facilitated.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made the drawings, in which:

FIG. 3 is a view showing in a table correlations between presence/absence of signals for fault decision and causes for occurrence of non-combustion event;

FIG. 4 is a view similar to FIG. 3 in the combustion state detecting apparatus in which a combustion state detection circuit is incorporated in an ignition coil;

DESCRIPTION OF THE PREFERRED EMBODIMENTS

Figure 1A:
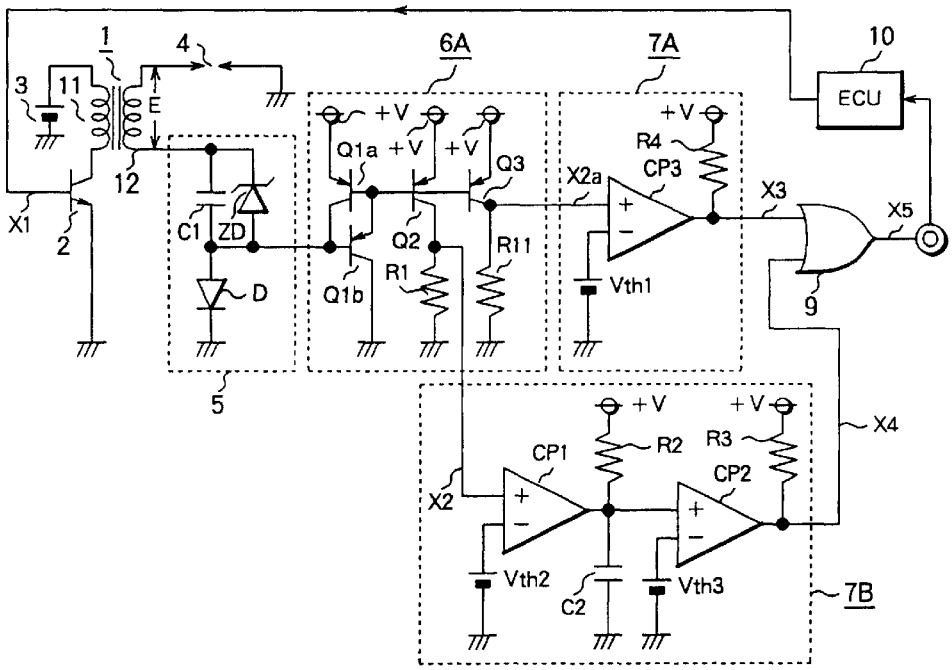
FIG. 1A is a circuit diagram showing schematically a configuration of a combustion state detecting apparatus for an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1A is a circuit diagram showing schematically a configuration of the combustion state detecting apparatus for an internal combustion engine according to a first embodiment of the present invention. In the figure, like reference symbols as those used in FIG. 5 denote components same as or equivalent to those described hereinbefore by reference to FIG. 5.

Now referring to FIG. 1A, reference character 6A denotes an ion current detecting circuit according to the first embodiment of the invention. In this ion current detecting circuit 6A, there is additionally provided a transistor Q3 having a base electrode connected to that of the transistor Q2, wherein the collector of the transistor Q3 is grounded by way of a resistor R11, while the emitter of the transistor Q3 is connected to a voltage source of plus polarity (+V). As can be seen in the figure, the ion current detecting circuit 6A is realized in the form of a current mirror circuit. The resistor R11 serves as a current-to-voltage converting element for converting the ion current flowing therethrough into an ion current detection voltage signal (hereinafter referred to as the ion current detection signal) X2*a*.

Reference character 7A denotes a first decision circuit which includes a comparator CP3 for comparing the level of the ion current detection signal X2*a* with a reference voltage Vthl to thereby shape the ion current detection signal X2*a* into a pulse signal which is outputted as a first decision signal X3. At this juncture, it should be mentioned that the noise current generated upon ignition operation is ordinarily in the order of several hundreds microamperes, and thus the noise current assumes a greater value than the ion current making appearance upon combustion of the air-fuel mixture within the engine cylinder. Such being the circumstances, the reference voltage Vth1 is set to a higher level than that of the reference voltage Vth2 which will be described hereinafter in consideration of the fact that the first decision circuit 7A which includes no mask circuit can output a pulse signal in response to insignificant signals such as external noise generated in accompanying the ignition or firing operation. Thus, according to the concept of the present invention incarnated in the instant embodiment; the reference voltage Vth1 for the comparator CP3 is set higher than not only the reference voltage Vth2 but also the voltage level of the small signal such as the external noise and the like with a view to suppressing the erroneous output of the first decision circuit 7A.

In this conjunction, it should be added that a decision circuit of the structure similar to that of the decision circuit 7 of the conventional combustion state detecting apparatus (see FIG. 5A) is also employed in the combustion state detecting apparatus according to the instant embodiment of the invention. This decision circuit will be referred to as the second decision circuit and designated by reference character 7B. Further, the decision signal outputted from the second decision circuit 7B on the basis of the ion current detection signal X2 will be referred to as the second decision signal X4 only for convenience of description.

Turning back to FIG. 1A, reference numeral 9 denotes a logical-OR circuit having inputs connected to the outputs of the first decision circuit 7A and the second decision circuit 7B, respectively, for logically ORing the first decision signal X3 and the second decision signal X4 to thereby output an output signal X5 which is then supplied to the ECU 10. Incidentally, the first decision circuit 7A of the combustion state detecting apparatus according to the instant embodiment of the invention is so designed as to output intactly the output of the comparator circuit without passing it through the delay circuit. Consequently, the noise components N1 and N2 as well as the ion current component shaped into pulse signals, respectively, by the comparator CP3 are outputted from the first decision circuit 7A.

Next, referring to a signal waveform diagram shown in FIG. 1B, description will be made of operations of the combustion state detecting apparatus according to the first embodiment of the invention in conjunction with normal combustion, a first type of non-combustion event due to a defect or fault of a fuel-supply/combustion system and a second type of non-combustion event due to a defect or fault of an ignition control system.

Figure 5A:
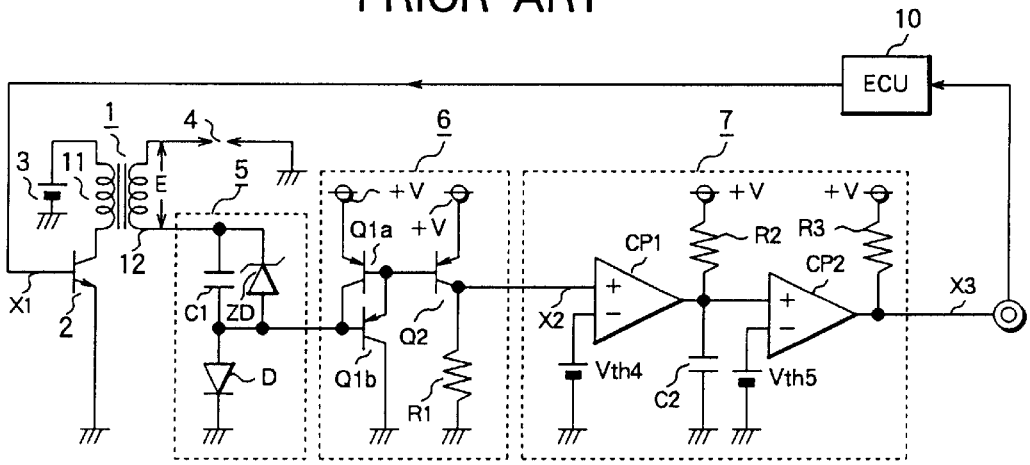
FIG. 5A PRIOR ART
FIG. 5A is a circuit diagram showing schematically an arrangement of a conventional combustion state detecting apparatus for an internal combustion engine.
Figure 5B:
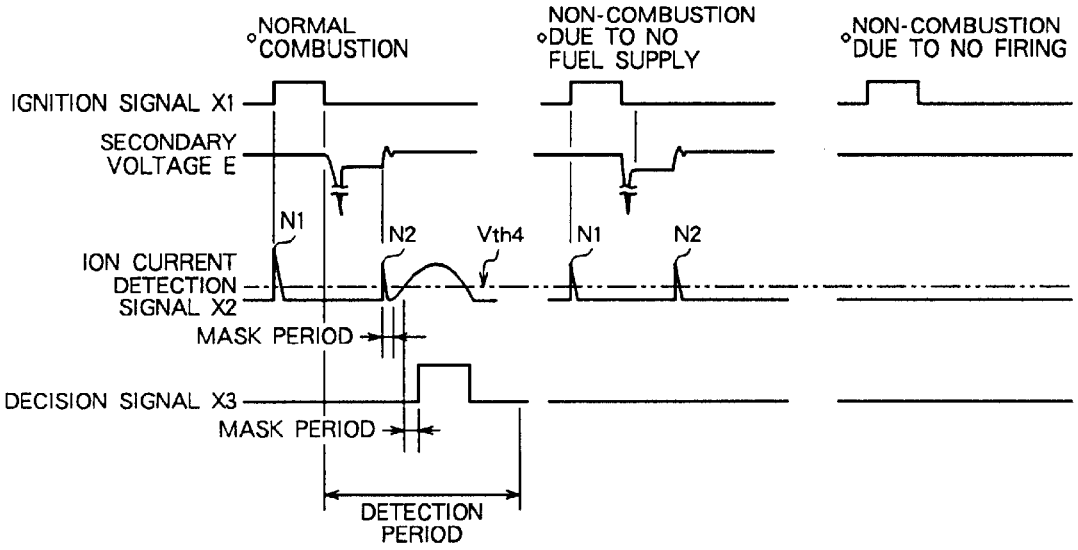
FIG. 5B PRIOR ART
FIG. 5B is a signal waveform diagram for illustrating operations of the conventional combustion state detecting apparatus.

Parenthetically, operation of the second decision circuit 7B is similar to that of the decision circuit described hereinbefore in conjunction with the conventional combustion state detecting apparatus by reference to FIG. 5A. Accordingly, repeated description of the second decision circuit 7B will be unnecessary.

1. Normal combustion

Upon combustion of the air-fuel mixture within the engine cylinder in succession to application of the ignition signal X1, only the pulse-shaped ion current component is outputted from the second decision circuit 7B as the second decision signal X4 with the noise components N1 and N2 having been eliminated. The second decision signal X4 is applied to one of the input terminals of the OR circuit 9

On the other hand, outputted from the first decision circuit 7A is the first decision signal X3 which is composed of the pulse-shaped ion current component and the noise components N1 and N2 also shaped into pulses. The first decision signal X3 is then applied to the other input terminal of the OR circuit 9. As a result of this, outputted from the OR circuit 9 as the output signal X5 is a logical sum signal which is composed of the first decision signal X3 supplied from the first decision circuit 7A and the second decision signal X4 supplied from the second decision circuit 7B in a time-serial sequence. The output signal X5 of the OR circuit 9 is then inputted to the ECU 10.

Upon reception of the output signal X5, the ECU 10 detects the first and second decision signals X3 and X4 during a first decision signal detection period set in a manner described below to thereby make decision that the combustion has taken place normally.

Figure 1B:
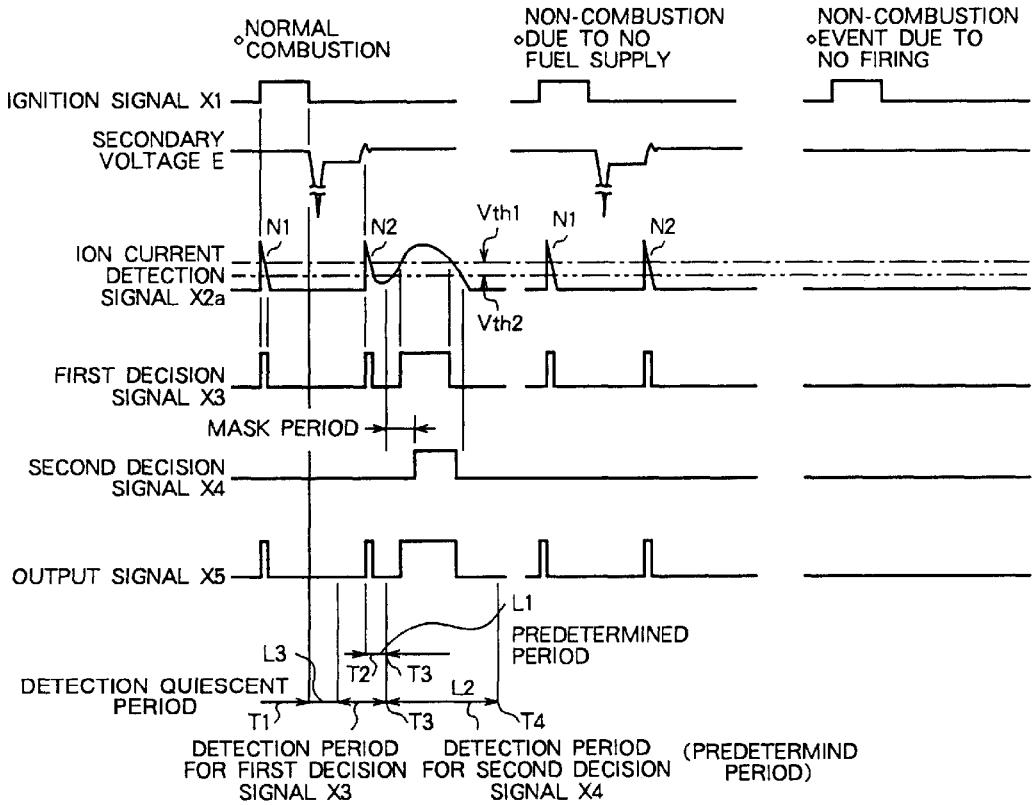
FIG. 1B is a signal waveform diagram for illustrating operations of the combustion state detecting apparatus shown in FIG. 1A in conjunction with a normal combustion, a first type of non-combustion event due to a fault of a fuel-supply/combustion system and a second type of non-combustion event due to a defect or fault of an ignition control system.

Referring to FIG. 1B, the time point T1 at which the ignition signal X1 is turned off (i.e., trailing or falling edge of the ignition signal X1) is defined as the detection start time point for the first decision signal X3, while a time point T3 corresponding to lapse of a predetermined time period L1 from the output start time point T2 of the first decision signal X3 is defined as the detection end time point for the first decision signal X3 while defining the time point T3 as the detection start time point for the second decision signal X4. Further, the time point corresponding to lapse of a predetermined time period L2 from the detection end time point T3 is defined as the detection end time point T4 for the second decision signal X4.

In this conjunction, it should be added that since there may arise possibility of ignition noise ascribable to ignition in the other cylinder(s) being superposed immediately after interruption of the ignition signal for the cylinder now concerned in the case where the simultaneous ignition scheme is adopted. Accordingly, a detection quiescent period during which the signal detecting operation remains quiescent is provided over a predetermined time period L3 starting from the interruption of the ignition signal X1 (i.e., turning-off of the power transistor 2).

2. Non-combustion event due to fault of fuel-supply/combustion system

When the fuel-supply/combustion system of the engine suffers some fault, the ion current due to the fuel combustion is not produced. Thus, no ion current component makes appearance in the ion current detection signals X2*a* and X2. However, the noise component N1 produced upon rising of the ignition signal X1 and the noise component N2 produced upon termination or extinction of the spark discharge can make appearance in the ion current detection signals X2*a* and X2, as a result of which the noise components N1 and N2 contained in the ion current detection signal X2*a* undergone the pulse shaping operation of the comparator CP3 are outputted from the first decision circuit 7A as the first decision signal X3, which is then applied to one input of the OR circuit 9. By contrast, the noise components N1 and N2 contained in the ion current detection signal X2 are eliminated by the delay circuit incorporated in the second decision circuit 7B. Consequently, the second decision signal X4 applied to the other input of the OR circuit 9 contains no noise components. Thus, the output signal X5 indicative of the noise components N1 and N2 is outputted from the OR circuit 9 to be inputted to the ECU 10.

The ECU 10 detects the first and second decision signals X3 and X4 during the first decision signal detection period set as mentioned previously in synchronism with the falling edge (trailing edge) of the ignition signal X1. In that case, the signal will be detected during the first detection period for the first decision signal X3 while no signal will be detected during the second detection period for the second decision signal X4. Thus, decision can be made that the non-combustion event is ascribable to a fault in the fuel-supply/combustion system.

As typical one of the faults in the fuel-supply/combustion system, there may be mentioned breakage (inter-coils short-circuit fault) of the secondary winding 12 of the ignition coil 1, breakage of a high-voltage conductor or cord used for interconnecting the spark plug 4 and the secondary winding 12 of the spark plug 4, occurrence of a smoldering state in the spark plug 4, fuel injection failure due to defect of the fuel supply system, e.g. fuel injector and/or the like, as can be seen from the table shown in FIG. 3.

3. Non-combustion event due to fault in the ignition control system

When no ignition or firing takes place due to breakage of the primary winding 11 of the ignition coil 1, the ignition signal X1 supplied to the input circuitry of the primary winding 11 of the ignition coil 1 exerts no influence to the output circuitry inclusive of the secondary winding 12 of the ignition coil 1. Consequently, there makes appearance no output signal X5 to be inputted to the ECU 10. As a result of this, the ECU 10 detects no signal of any significance during the first detection period for the first decision signal X3 and the second detection period for the second decision signal X4. Thus, decision is made that occurrence of the non-combustion event is due to some fault in the ignition control system.

As typical ones of the fault of the ignition control system, there may be mentioned nongeneration of the ignition signal due to fault of the ECU 10, breakage of the ignition signal conductor, defect of the power transistor 2 serving for turning on/off the current supply to the ignition coil 1 in response to the ignition signal, breakage of the primary winding of the ignition coil 1, breakage of the ion current conductor, generation of no output signal from the combustion state detector not shown or the like.

Embodiment 2

In the case of the combustion state detecting apparatus for the internal combustion engine according to the first embodiment of the invention, the normal combustion, the non-combustion events and the faults which lead to occurrence of such non-combustion event can be discriminatively decided or determined on the basis of detection of the first and second decision signals X3 and X4 based on the noise component N1 produced at the discharge end time point and the ion current produced in accompanying the combustion. The combustion state detecting apparatus according to a second embodiment of the present invention is so designed that the normal combustion and the fault(s) bringing about the non-combustion event can be discriminatively determined or decided on the basis of the first decision signal X3A generated upon rising of the ignition signal X1 and the ion current produced in accompanying the combustion.

Figure 2A:
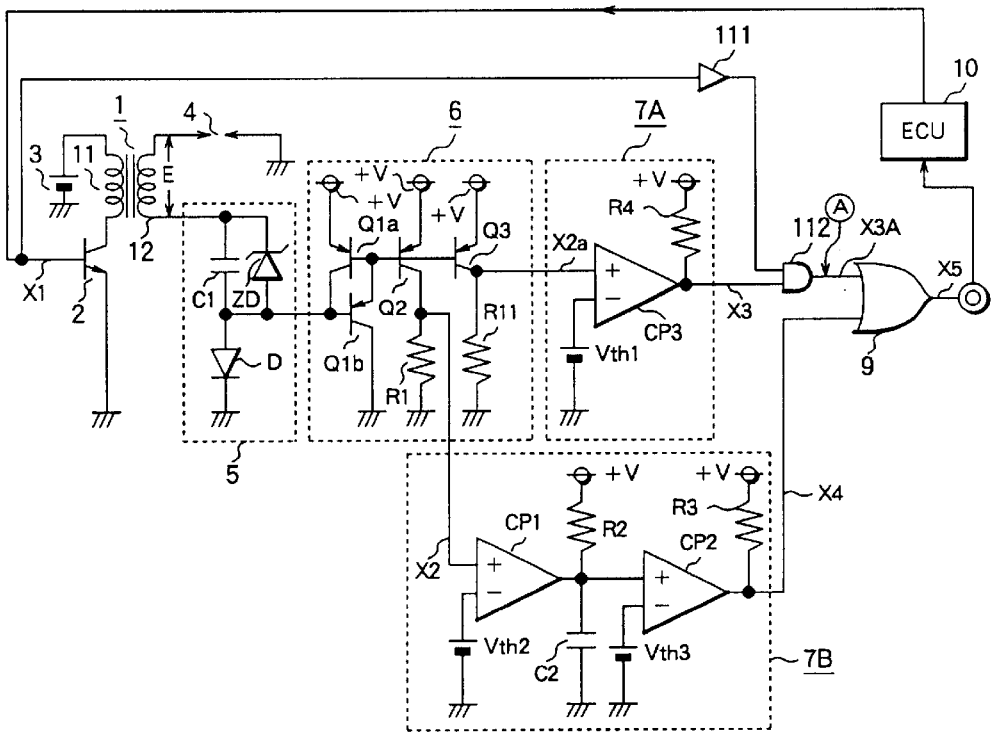
FIG. 2A is a circuit diagram showing schematically a structure of the combustion state detecting apparatus for an internal combustion engine according to a second embodiment of the present invention.

FIG. 2A is a circuit diagram showing schematically a structure of the combustion state detecting apparatus for the internal combustion engine according to the second embodiment of the present invention. In FIG. 2A, components similar or equivalent to those described hereinbefore by reference to FIG. 1A are denoted by like reference characters. The second embodiment of the invention differs from the first embodiment in the respects that an AND circuit 112 is provided for logically ANDing the output of the comparator CP3 constituting a part of the first decision circuit 7A and the ignition signal X1 inputted by way of a buffer 111 and that the OR circuit 9 is so connected as to logically ORing the first decision signal X3A outputted from the AND circuit 112 and the second decision signal X4 outputted from the second decision circuit 7B.

Figure 2B:
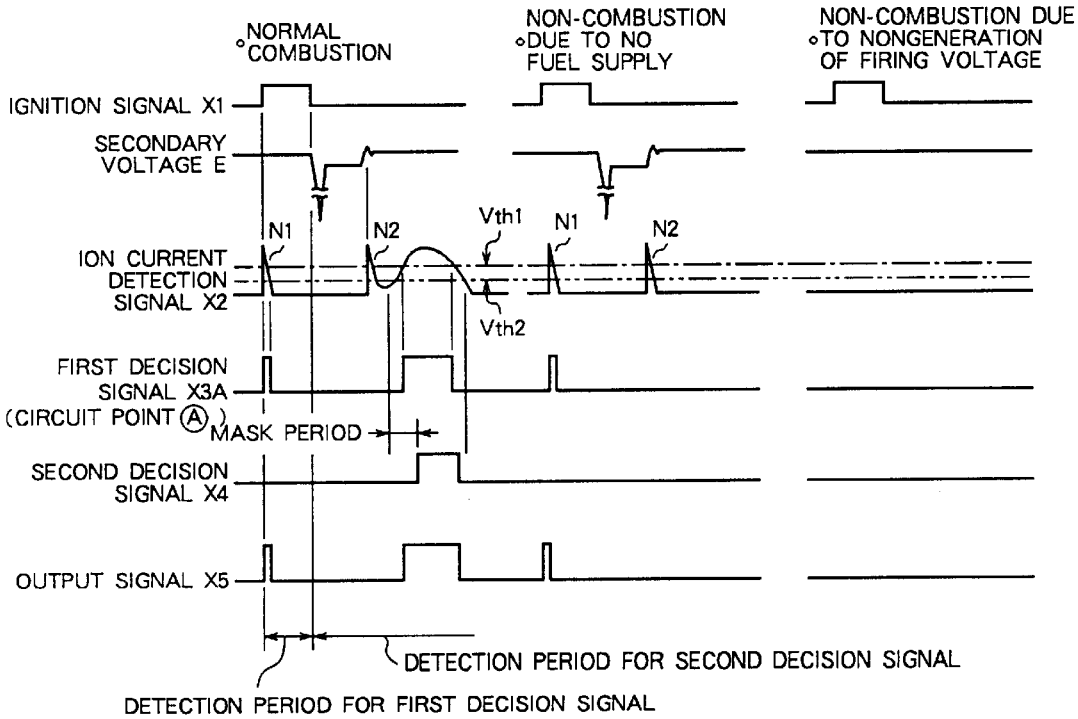
FIG. 2B is a signal waveform diagram for illustrating operations of the combustion state detecting apparatus shown in FIG. 2A in conjunction with normal combustion, a first type of non-combustion event due to a defect or fault of the fuel-supply/combustion system and a second type of non-combustion event due to a defect or fault of the ignition control system.

Next, referring to a signal waveform diagram shown in FIG. 2B, description will be made of operations of the combustion state detecting apparatus according to the second embodiment of the invention in conjunction with the normal combustion, the first type of non-combustion event due to a defect or fault of the fuel-supply/combustion system and the second type of non-combustion event due to a defect or fault of the ignition control system. Incidentally, the faults of the fuel-supply/combustion system as well as faults of the ignition system are essentially same as those described hereinbefore in conjunction with the first embodiment of the invention. Besides, the operations of the first and second decision circuits 7A and 7B are similar to those of the combustion state detecting apparatus according to the first embodiment. Accordingly, repeated description thereof will be unnecessary.

1. Normal combustion

So long as the normal combustion is taking place within the engine cylinder, the noise components N1 and N2 and the ion current produced in accompanying the combustion are detected as the ion current detection signal X2.

Consequently, the first decision signal X3 is inputted to one of the input terminals of the AND circuit 112 from the comparator CP3 as in the case of the combustion state detecting apparatus according to the first embodiment of the invention. On the other hand, inputted to the other input terminal of the AND circuit 112 by way of the buffer 111 is the ignition signal X1. Consequently, the AND circuit 112 outputs the first decision signal X3A resulting from the pulse shaping of the noise component N1 generated upon rising of the ignition signal X1 in synchronism with the application of the ignition signal X1. The first decision signal X3A is applied to one of input terminals of the OR circuit 9.

On the other hand, applied to the other input terminal of the OR circuit 9 is the second decision signal X4. Thus, the logical sum OR of the first decision signal X3A and the second decision signal X4 is outputted from the OR circuit 9 as the output signal X5 which is then supplied to the ECU 10. In this way, when the signal corresponding to the second decision signal X4 is detected after lapse of a predetermined time from the time point at which the first decision signal X3A was detected in synchronism with application of the ignition signal X1, then it is decided that the normal combustion has taken place.

2. Non-combustion event due to fault in fuel-supply/combustion system

When the non-combustion event occurs due to absence of the fuel supply, no ion current can flow through the inter-electrode gap of the spark plug. Consequently, the second decision signal X4 is not generated. However, since the noise component N1 produced upon application of the ignition signal X1 is outputted, the first decision signal X3A is supplied to the OR circuit 9 from the AND circuit 112 in synchronism with rising of the ignition signal X1, as a result of which the first decision signal X3A is outputted from the OR circuit 9 as the output signal X5 which is then supplied to the ECU 10.

Thus, when only the signal (i.e., output signal X5) produced in synchronism with rising of the ignition signal X1 is detected by the ECU 10, it is decided that the non-combustion event due to a fault in the fuel-supply/combustion system has occurred.

3. Non-combustion event due to fault in the ignition control system

It is assumed, by way of example, that no ignition or firing takes place due-to breakage of the primary winding 11 of the ignition coil 1. In that case, the ignition signal X1 applied to the input circuitry for the primary winding 11 of the ignition coil 1 exerts no influence to the output circuitry provided in association with the secondary winding 12 of the ignition coil 1. Consequently, the output signal X5 is not supplied to the ECU 10.

In this case, neither the first decision signal X3A due to the application of the ignition signal X1 nor the second decision signal X4 due to the combustion is detected, and thus decision is made such that the non-combustion event is ascribable to no appearance of the high voltage across the secondary winding 12 of the ignition coil 1, which means that the ignition system suffers some fault.

Absence of the output signal during the detection period of the second decision signal X4 indicates occurrence of non-combustion. In that case, the type of fault can be discriminatively identified in dependence on whether the first decision signal X3 is outputted or not, as summarized in the table shown in FIG. 4.

More specifically, when the first decision signal X3 is outputted, this means that the high secondary voltage for the ignition or firing is generated. Thus, as the fault, there can be estimated the inter-layer short-circuit fault of the secondary winding 12 of the ignition coil 1, breakage of high-voltage cord, smoldering of the spark plug 4, some defect in the fuel-supply/combustion system or the like.

In the combustion state detecting apparatus in which the combustion state detector composed of the first and second decision circuits 7A and 7B is built in the ignition coil 1, absence of the first decision signal X3A indicates that some fault is taking place in the ECU 10, the ignition signal conductor or the ignition coil 1, as can be seen in FIG. 4.

In this conjunction, it is to be added that when the first decision signal X3A is not outputted from the AND circuit 112, fault diagnosis can be performed for the ECU 10 and the ignition signal conductor by monitoring the ignition signal with the ECU 10. When this diagnosis results in no abnormality of the ignition signal, then it can be discriminatively determined that the ignition coil 1 is suffering a fault.

Many modifications and variations of the present invention are possible in the light of the above techniques. It is therefore to be understood that within the scope of the appended claims, the invention may be practiced otherwise than as specifically described.

What is claimed is:

1. A combustion state detecting apparatus for an internal combustion engine, comprising:

a spark plug for generating a spark discharge upon application of a high voltage generated by an ignition coil in response to an ignition signal to thereby fire an air-fuel mixture within a cylinder of the internal combustion engine;

ion current detecting means for detecting as ion current detection signals an ion current corresponding to an amount of ions produced within said cylinder immediately after combustion of said air-fuel mixture;

signal detecting means designed for comparing said ion current detection signal outputted from said ion current detecting means with a first reference voltage to thereby output a first decision signal while comparing the ion current detection signal with a second reference voltage to thereby output a second decision signal while invalidating output of said second decision signal during a predetermine time period from a time point at which said comparison of the ion current detection signal with said second reference voltage is started; and estimating means for estimating a cause for nongeneration of a combustion signal on the basis of output statuses of said first decision signal and said second decision signal.

2. A combustion state detecting apparatus for an internal combustion engine according to claim 1, said signal detecting means includes:

a first detecting unit for detecting noise signal components on the basis of result of the comparison of said ion current detection signal with said first reference voltage; and a second detecting unit for detecting an ion current component due to the combustion of the air-fuel mixture on the basis of result of the comparison of the ion current detection signal with said second reference voltage set lower than said first reference voltage.

3. A combustion state detecting apparatus for an internal combustion engine according to claim 1, wherein said ion current detecting means and said signal detection means are built in said ignition coil.

4. A combustion state detecting apparatus for an internal combustion engine according to claim 1, wherein said estimating means is so designed as to set a predetermined time period extending from a time point at which output of said first decision signal is started after firing of the air-fuel mixture as a detection period for said first decision signal while setting a predetermined period extending from a time point at which said detection period for said first decision signal is terminated as a detection period for said second decision signal so that said first and second decision signals can be detected discriminatively from each other.

5. A combustion state detecting apparatus for an internal combustion engine according to claim 4, wherein said estimating means is so designed as to set a signal detection quiescent period over a predetermined time period which succeeds immediately to interruption of said ignition signal.

6. A combustion state detecting apparatus for an internal combustion engine according to claim 4, wherein said estimating means is so designed as to output noise component signals only during an output period of said ignition signal.

7. A combustion state detecting apparatus for an internal combustion engine according to claim 6, wherein said estimating means is so designed as to limit a detection period for said noise component signals to within the output period of said ignition signal.

* * * * *